United States Patent [19]

Schroëder et al.

[11] 4,045,755

[45] Aug. 30, 1977

[54] ARMATURE MOUNTING MEANS FOR AN ELECTROMAGNETIC RELAY

[75] Inventors: Harry Schroëder, Unterhaching; Martin Aidn, Munich, both of Germany

[73] Assignee: Siemens Aktiengesellschaft, Berlin & Munich, Germany

[21] Appl. No.: 751,807

[22] Filed: Dec. 17, 1976

[30] Foreign Application Priority Data

Dec. 22, 1975 Germany ..... 2558065

[51] Int. Cl.[2] ..... H01F 7/08

[52] U.S. Cl. ..... 335/274; 335/276

[58] Field of Search ..... 335/270, 273, 274, 276

[56] References Cited

U.S. PATENT DOCUMENTS

| | | | |
|---|---|---|---|
| 2,455,690 | 12/1948 | Matthias | 335/276 |
| 3,117,255 | 1/1964 | Peterson | 335/276 X |
| 3,365,683 | 1/1968 | Aidn et al. | 335/276 X |

FOREIGN PATENT DOCUMENTS

| | | | |
|---|---|---|---|
| 1,318,219 | 5/1973 | United Kingdom | 335/274 |

*Primary Examiner*—George Harris

*Attorney, Agent, or Firm*—Hill, Gross, Simpson, Van Santen, Steadman, Chiara & Simpson

[57] ABSTRACT

An electromagnetic relay having a return pole piece, a substantially L-shaped armature and an elongated mounting spring for clamping the armature to the return pole piece. The corner portion of the armature is supported by an upper edge of the return pole piece, and the ends of the mounting spring engage the armature and the return pole piece for providing a clamping force, the line of which passes in close proximity to the supporting edge of the return pole piece to produce an armature resetting moment.

7 Claims, 7 Drawing Figures

ARMATURE MOUNTING MEANS FOR AN ELECTROMAGNETIC RELAY

BACKGROUND OF THE INVENTION

This invention relates generally to the field of electromagnetic relays and more particularly to such a relay having an angular or substantially L-shaped armature which is mounted on one edge of a return pole piece and held thereon by means of an elongated curved spring, one end of which engages the return pole piece through an aperture formed therein and the other end of which engages the armature in an external notch or recess formed therein.

Such an arrangement is generally known in the prior art. In German Specification No. 1,292,752, for example, there is disclosed a claw-shaped mounting spring held by means of a screw, the resetting moment of the armature being adjustable by means of the screw. Such adjustability as provided by the screw is desirable for certain relay applications but involves additional expenses in production and assembly operations. Thus the screw must be made as a separate part, fitted and then adjusted.

In many relay applications, however, the number of contact springs to be actuated is determined beforehand, and even the resetting moment is predetermined. In such applications it is desirable to eliminate the costly screw adjustment and obtain the desired force conditions using a minimum number of parts and a minimum number of production and assembly operations.

SUMMARY OF THE INVENTION

In accordance with the foregoing, it is an important object of the present invention to provide an electromagnetic relay having an armature mounting which is capable of performing favorably, which involves a minimum expense in terms of production and assembly costs, and which can carry out a substantial number of switching operations without difficulty, even when subjected to vibration loadings.

In accordance with the principles of the present invention, this object is achieved by providing a mounting spring which clamps the armature to the return pole piece without the necessity of screws or the like fastening devices and in a manner whereby the line of biasing force between the ends of the spring extends approximately through an edge formed on the return pole piece on which the armature is pivotally supported.

As a consequence of the present invention the adjusting screw heretofore utilized, or other fastening means, is no longer required, since the curved mounting spring alone provides the requisite clamping force. The armature resetting moment can be varied by varying the configuration of a notch or recess formed in the armature and in which one end of the spring resides, and by varying the point (line) of contact of the other end of the spring and the return pole piece. These design considerations can be determined in advance, so that adjustment during production is unnecessary.

Preferably, the edge-mounting arrangement of the armature is produced as simply as possible, the return pole piece having no grooves or raised contours formed therein or thereon in the vicinity of the supporting edge thereof, whereby the return pole piece can be manufactured with straight cutting dies. The corresponding bearing or mounting edge formed on the inside of the corner of the L-shaped armature extends without interruption across the entire width of the armature without the necessity for recesses. As a consequence, the armature does not require a reaming operation and similar costly free-cutting operations during production are eliminated.

According to the invention, lateral wandering of the armature on the straight armature supporting edge can be easily prevented. Thus the armature recess into which one end of the mounting spring extends is rounded, and has a radius of curvature which is slightly less than the radius of curvature of the recess wall. In addition, the opposite end of the mounting spring is attached to the return pole piece with a minimal lateral play over the broadest possible base.

The somewhat severe impact and vibration loadings to which the magnet system is often subjected can be absorbed and minimized through suitable contouring of the chassis on which the magnet system is mounted. The contouring provides appropriate projections which allow the armature to lift only slightly out of engagement with the return pole piece, thereby preventing over-extension of the mounting spring. Lateral travel in a direction parallel to the supporting edge of the return pole piece can also be absorbed and minimized by suitable contouring of the chassis.

Many other features, advantages and additional objects of the present invention will become manifest to those versed in the art upon making reference to the detailed description which follows and the accompanying sheet of drawings, in which preferred structural embodiments incorporating the principles of the present invention are shown by way of illustrative example only.

DESCRIPTION OF THE PREFERRED EMBODIMENTS

Figure 1:
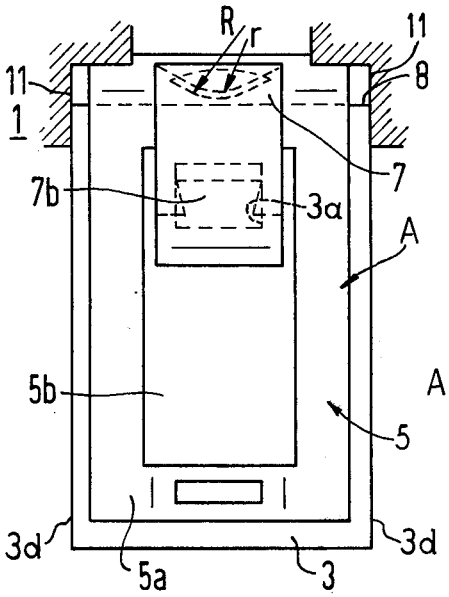
FIG. 1 is a front elevational view of an electromagnetic relay constructed in accordance with the principles of the present invention.
Figure 2:
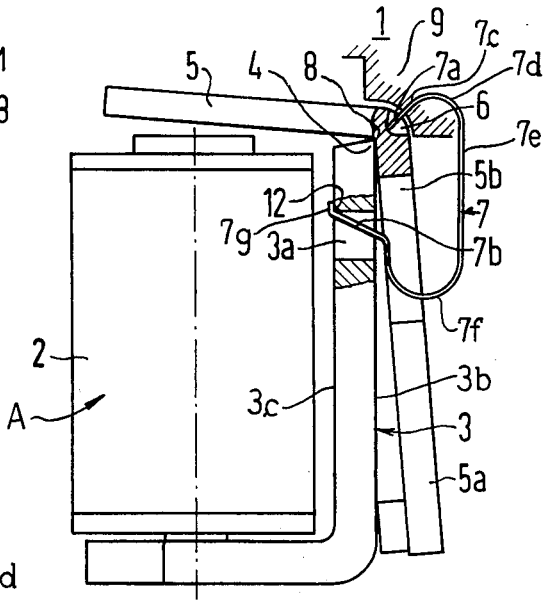
FIG. 2 is a side elevational view of the electromagnetic relay shown in FIG. 1.

Referring to FIGS. 1–4, there is shown an electromagnetic relay constructed in accordance with the principles of the present invention and indicated generally at reference character A. The relay A is shown mounted in a chassis 1 which is constructed of suitable insulating material. Included among the components of the relay A are a coil 2, a return pole piece 3 and an armature 5.

The return pole piece 3 has an outer wall $\mathbf{3}_b$, an inner wall $\mathbf{3}_c$ and a pair of side walls $\mathbf{3}_d$, $\mathbf{3}_d$. The armature 5 is generally L-shaped, and includes a first leg portion $\mathbf{5}_a$, a second leg portion $\mathbf{5}_c$ and a curved or arcuate corner portion $\mathbf{5}_d$ which interconnects the leg portions $\mathbf{5}_a$ and $\mathbf{5}_c$.

Return pole piece 3 is formed with an upper straight edge 4 which supports the armature 5 for pivotal movement, the edge 4 engaging an inner surface 8 of the corner portion $\mathbf{5}_d$. The armature 5 is clamped to the return pole piece 3 by means of an elongated curved mounting spring 7. One end portion $7_a$ of the mounting spring 7 is bottomed on a lower wall $6_a$ of a notch or recess 6 formed in an outer surface $6_b$ of the armature corner portion $5_d$. The mounting spring 7 extends upwardly and at an angle to the end portion $7_a$ as indicated at reference numeral $7_c$ and also includes an arcuate portion $7_d$ which leads to a vertical portion $7_e$. At the lower end of portion $7_e$ is another arcuate portion $7_f$ which extends through an aperture $5_b$ and connects to the opposite end portion $7_b$ of the spring 7. It is noted that the end portion $7_b$ extends through an aperture $3_a$ formed in the return pole piece $3_c$ and includes a lip or flange portion $7_g$ which abuts an edge surface 12 adjacent the aperture $3_a$ of the return pole piece 3.

Figure 4:
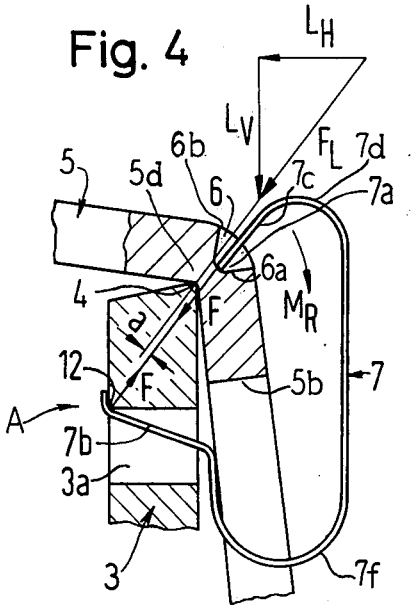
FIG. 4 is an enlarged view of a portion of the electromagnetic relay shown in FIG. 2.

As best shown in FIG. 4, the line of the biasing force exerted by the mounting spring 7 between the return pole piece 3 and the armature 5, as indicated at F, is slightly displaced or offset with respect to a line extending parallel thereto and passing through the supporting edge 4 of the return pole piece 3, the distance between the parallel lines being indicated at reference character a in FIG. 4. This offset produces a desired armature resetting moment which may be defined by the formula $M_R = F \times a$, where $M_R$ = the resetting moment, F equals the biasing force produced by the mounting spring 7 between the ends $6_a$ and $7_b$, and a equals the distance between the biasing force and the supporting edge 4 of the return pole piece 3.

Figure 3:
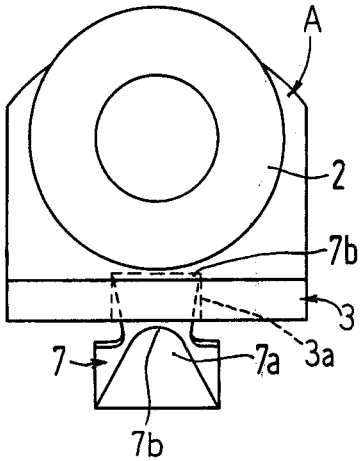
FIG. 3 is a top plan view of the electromagnetic relay shown in FIGS. 1 and 2, with portions thereof removed for purposes of clarity.

During normal operation the pre-loading of the mounting spring 7 provides the necessary mounting or clamping forces between the return pole piece 3 and the armature 5. Under fairly severe impact or vibration loadings a contoured portion 9 of the chassis 1 permits only slight lifting of the armature 5 with respect to the return pole piece 3. By virtue of this arrangement an over-extension of the mounting spring 7 is avoided. To prevent excessive lateral movement of the armature 5 along the length of the supporting edge 4 of the return pole piece 3, the upper end portion $7_a$ of the mounting spring 7 is arcuately shaped, as best shown in FIG. 3 at reference character $7_h$. The recess wall $6_a$ in which the spring end portion $7_a$ resides is similarly curved.

For example, in FIG. 1 the reference character R indicates the radius of curvature of the lower wall $6_a$ of the recess 6, whereas reference character *r* indicates the radius of curvature of the end wall $7_h$ of the mounting spring 7. In accordance with the principles of the present invention, the radius of curvature *r* is slightly less than the radius of curvature R, whereby a centering effect is produced on the mounting spring 7 relative to the armature 5.

In addition, excellent stabilization of the armature 5 is achieved by constructing the lower end $7_b$ of the mounting spring 7 such that it abuts a substantial length of the abutment surface 12 of the return pole piece 3. Furthermore, fairly severe impact loading of the armature 5 in a lateral direction, that is, in the direction of the supporting edge 4, is also limited by virtue of the confining wall 11 of the chassis 1.

Referring again to FIG. 4, it is apparent that the spring ends $7_a$ and $7_b$ are biased against one another by virtue of the spring force F, generating a mounting force indicated at reference character $F_L$. The mounting force $F_L$, as shown in the vector diagram, comprises a horizontal force component $L_H$ and a vertical force component $L_V$, from which it is apparent that the mounting force $F_L$ returns the armature 5 back into engagement with the supporting edge 4 of the return pole piece 3 in the event severe vibration loading momentarily lifts the armature 5 from the supporting edge 4.

Figure 5:
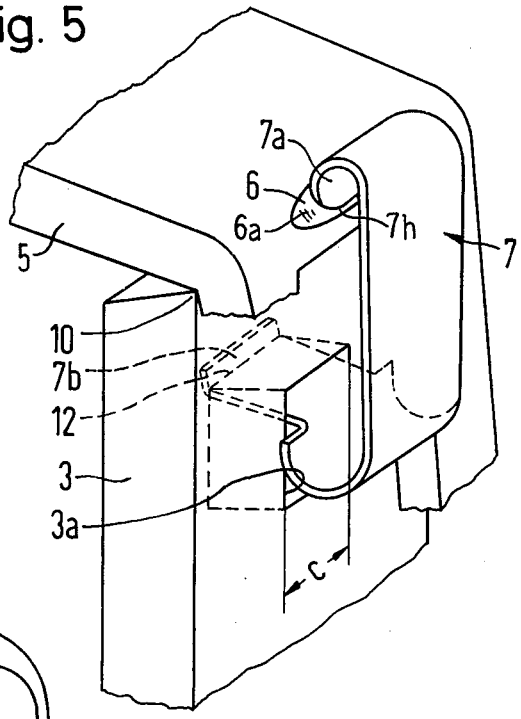
FIGS. 5, 6 and 7 are, respectively, perspective views of portions of other embodiments of the invention.

In the perspective view illustrated in FIG. 5, the centering effect of the mounting spring 7 is clearly illustrated. Thus the curved edge $7_h$ of the upper end $7_a$ of the spring 7 abuts the curved recess wall $6_a$ of the recess 6. On the other hand, the lower end portion $7_b$ is of a width *c* which is only slightly less than the corresponding width of the aperture $3_a$ formed in the return pole piece 3. In addition, the flange of the end portion $7_b$ engages the inner wall $3_c$ of the return pole piece 3 substantially along the entire width of the recess $3_a$. Thus the mounting spring 7 constantly urges the armature 5 to a centering position with respect to the return pole piece 3.

Figure 6:
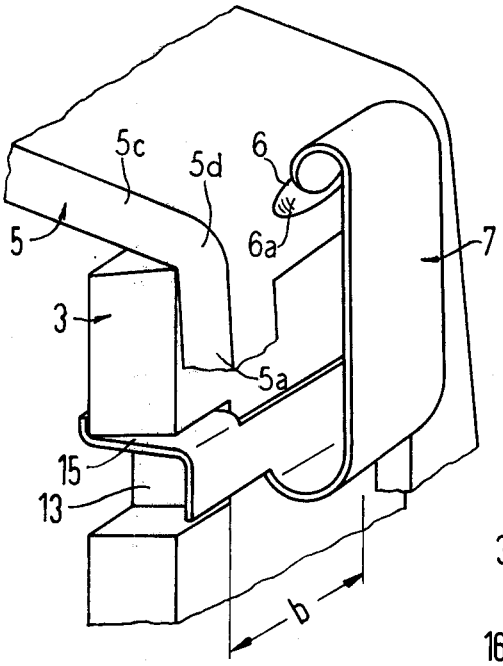

If desirable, the mounting spring 7 can be formed to engage the return pole piece 3 over even a broader base, as shown in the embodiment of the invention illustrated in FIG. 6. In that embodiment the aperture $3_a$ is eliminated and a pair of apertures 13 are formed in the side walls $3_d$, $3_d$ of the return pole piece 3, and the lower end of the mounting spring 7 comprises a pair of spring ends 15, 15 which extend through the apertures 13. In this arrangement the lower end of the mounting spring 7 also engages the outer wall $3_b$ across a distance indicated by reference character b.

Figure 7:
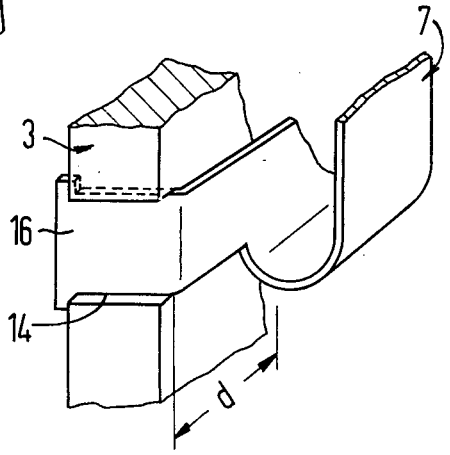

In the embodiment shown in FIG. 7, the aperture $3_a$ of the embodiment shown in FIGS. 1–4 is replaced by a pair of smaller apertures opening to the side walls $3_d$, $3_d$ of the return pole piece 3, and the lower end of the mounting spring 7 comprises a pair of extensions 16, 16. It should be noted that the extensions 16, 16 extend through the apertures 14, 14 in a direction parallel to the side walls $3_d$, $3_d$ of the return pole piece 3, whereas in the embodiment shown in FIG. 6 the lower end of the mounting spring 7 extends through the apertures 13, 13 in a direction substantially transverse to the return pole piece side walls $3_d$, $3_d$.

In some instances, therefore, the configurations of the mounting spring 7 shown in FIGS. 6 and 7 may be preferred to the arrangement shown in FIG. 1–5 for improved centering capabilities of the mounting spring 7 relative to the return pole piece 3 and the armature 5.

Although minor modifications might be suggested by those versed in the art, it should be understood that we wish to embody within the scope of the patent warrented hereon all such modifications as reasonably come within the scope of my contribution to the art.

We claim as our invention;

1. An electromagnetic relay comprising an armature having a first leg portion, a second leg portion extending at an angle to said first leg portion and a corner portion interconnecting said first and second leg portions, said corner portion having an inner surface and an outer surface, said inner surface having means forming a mounting edge and said outer surface having means forming a recess, a return pole piece having an outer surface disposed adjacent said second leg portion of said armature, an inner surface and means forming a supporting edge for receiving said mounting edge of said armature and for supporting said armature for pivotal movement, said second leg of said armature having means forming an aperture therein, and an elongated curved mounting spring for clamping said armature to said return pole piece and having a first end portion abutting said corner portion of said armature in said recess, a middle portion extending through said aperture and a second end portion disposed in spaced relation to said first end portion and abutting said return pole piece on said inner surface for biasing said mounting edge of said armature into abutting engagement with said supporting edge of said return pole piece, said mounting edge of said armature and said supporting edge of said return pole piece residing substantially between said first and second leg portions of said mounting spring.

2. The invention as defined in claim 1 wherein said means forming said recess in said armature corner portion comprises a curved recess wall having a predetermined radius of curvature and wherein said first end portion of said mounting spring abuts said recess wall, said first end portion being curved and having a predetermined radius of curvature which is less than the radius of curvature of said recess wall.

3. The invention as defined in claim 1, said return pole piece having means forming an aperture in alignment with said aperture formed in said armature, said middle portion of said mounting spring extending through said return pole piece aperture and said second end portion of said mounting spring abutting said inner surface of said return pole piece adjacent said aperture thereof.

4. The invention as defined in claim 1, said return pole piece having a pair of side walls and means forming an aperture in each of said side walls, said second end portion of said mounting spring being so configured as to provide a pair of tongue-shaped members extending respectively through said apertures of said side walls.

5. The invention as defined in claim 4 wherein said tongue-shaped members are substantially planar in configuration and are arranged substantially transversely of said side walls.

6. The invention as defined in claim 4 wherein said tongue-shaped members are substantially planar in configuration and are arranged substantially parallel to said side walls.

7. The invention as defined in claim 1 wherein said first and second end portions of said mounting spring are arranged with respect to said supporting edge of said return pole piece so that the biasing force generated by said mounting spring provides an armature resetting moment relative to said return pole piece.

* * * * *